US005333777A

United States Patent [19]

Roth

[11] Patent Number: 5,333,777

[45] Date of Patent: Aug. 2, 1994

[54] CONTAINER FOR STACKS OF SHEETS

[76] Inventor: Oscar Roth, Reblandstrasse 17, CH-5622 Waltenschwil, Switzerland

[21] Appl. No.: 903,086

[22] Filed: Jun. 19, 1992

[30] Foreign Application Priority Data

Jun. 19, 1991 [CH] Switzerland ..... 1812/91-3

[51] Int. Cl.[5] ..... B65D 5/32; B65D 5/48

[52] U.S. Cl. ..... 229/117.16; 229/23 R; 229/120.38; 229/122.2; 229/164; 229/191; 229/918

[58] Field of Search ..... 229/23 R, 23 BT, 117.16, 229/122.2, 120.38, 162, 164, 191, 918, DIG. 11; 206/804

[56] References Cited

U.S. PATENT DOCUMENTS

| | | | |
|---|---|---|---|
| 2,885,137 | 5/1959 | Guyer | 229/918 |
| 2,894,666 | 7/1959 | Campbell, Jr. | 229/122.2 |
| 2,973,127 | 2/1961 | Royce | 229/117.16 |
| 3,425,544 | 2/1969 | Ayer et al. | 229/117.16 |
| 3,704,823 | 12/1972 | Howe | 229/164 |
| 3,784,082 | 1/1974 | Hurlock | 229/164 |
| 3,934,790 | 1/1976 | Easter | 229/23 R |
| 4,101,052 | 7/1978 | Dove | 229/117.16 |
| 4,418,863 | 12/1983 | Kimbrell, Sr. | 229/918 |
| 4,427,108 | 1/1984 | Coles et al. | 229/164 |
| 4,842,572 | 6/1989 | Roth | 493/357 |
| 4,871,067 | 10/1989 | Valenti | 229/164 |
| 4,948,033 | 8/1990 | Halsell, II et al. | 229/DIG. 11 |
| 4,955,854 | 9/1990 | Roth | 493/357 |
| 5,051,058 | 9/1991 | Roth | 414/789 |
| 5,076,491 | 12/1991 | Freudentahl et al. | 229/117.16 |

FOREIGN PATENT DOCUMENTS

| | | | |
|---|---|---|---|
| 0177304 | 4/1986 | European Pat. Off. . | |
| 0178717 | 4/1986 | European Pat. Off. . | |
| 4717070 | 1/1988 | European Pat. Off. . | |
| 0266321 | 5/1988 | European Pat. Off. . | |
| 394544 | 10/1990 | European Pat. Off. | 229/164 |
| 2816563 | 10/1979 | Fed. Rep. of Germany | 229/DIG. 11 |
| 1010936 | 11/1965 | United Kingdom | 229/191 |
| 1321976 | 7/1973 | United Kingdom | 229/23 R |
| 2220406 | 1/1990 | United Kingdom | 229/191 |

*Primary Examiner*—Gary E. Elkins
*Attorney, Agent, or Firm*—Darby & Darby

[57] ABSTRACT

A container of cardboard or other relatively stiff material has a square or rectangular bottom wall, two parallel sidewalls and two end walls at least one of which is shorter than the sidewalls. This renders it possible to gain access to the confined goods, such as one or more stacks of paper sheets or the like, even if the goods completely fill the container. The end walls are adhesively secured or stapled to flaps which are integral with the respective ends of the sidewalls and are bent toward each other to define a gap above the corresponding relatively short end wall or end walls. The distance between each pair of confronting flaps can exceed half the distance of the sidewalls from each other.

22 Claims, 4 Drawing Sheets

Fig. 5
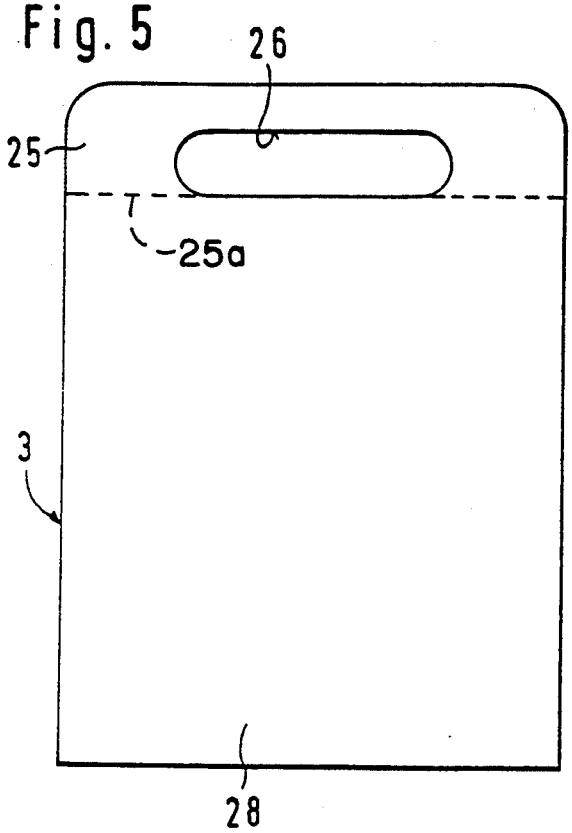
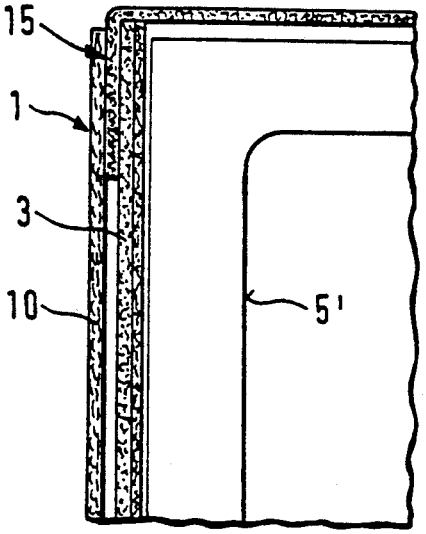
Fig. 9
Fig. 6
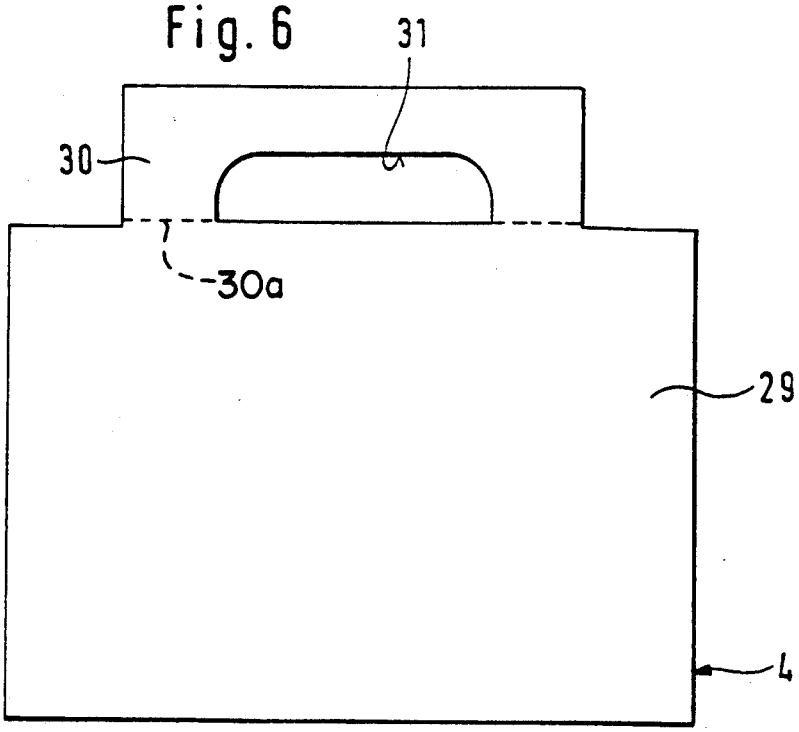

CONTAINER FOR STACKS OF SHEETS

BACKGROUND OF THE INVENTION

The invention relates to containers in general, and more particularly to improvements in containers of the type known as boxes. Still more particularly, the invention relates to improvements in box-shaped containers which can be made of cardboard or other relatively stiff material and which can be utilized with advantage for temporary or longer-lasting storage of stacks of paper sheets or the like.

It is known to drape reams paper sheets (e.g., sheets of copy paper) into wrappers of paper, foil or other suitable wrapping material and to stack five of the resulting packages on top of each other in a container of cardboard or the like. The five packages at least substantially fill the respective container, and the uppermost package can be concealed beneath a standard cover having depending lateral walls which overlie the top portions of external surfaces of upstanding sidewalls and end walls of the container. The cover is telescoped onto the open top of the container. An advantage of such containers is that they can be practically completely filled with. commodities in the form of packages of paper sheets or the like. However, such containers also exhibit certain serious drawbacks, especially as concerns the convenience of removing the cover and/or of removing individual packages of groups of two or more packages from the space between the bottom wall and the side- and end walls of the container. Moreover, it is rather difficult to remove a portion of or the entire wrapper of a package while the latter is still confined in the space between the bottom, side- and end walls of the container. On the other hand, it is often desirable and necessary to gain access to the interior of a properly filled and covered container with little loss in time and with a minimum of effort, e.g., to withdraw wrapped reams of copying paper in an office or a similar establishment. The same holds true for removal of wrapped reams of printing paper from containers which are made of cardboard or other suitable form-retaining material. For example, a secretary or clerk in an office should be capable of removing a wrapped package of paper sheets from a cardboard box with a minimum of effort preparatory to insertion into a computer, a copying machine or a telecopier.

OBJECTS OF THE INVENTION

An object of the invention is to provide a novel and improved container of cardboard or the like which is constructed in such a way that it can be assembled or taken apart with little loss in time and with the exertion of a small force.

Another object of the invention is to provide a container of cardboard or the like which is designed to permit convenient removal of sheets or packages of sheets, even if the sheets or the packages of sheets fill the container to capacity.

A further object of the invention is to provide a container which is designed, constructed and assembled in such a way that it facilitates convenient and effortless insertion of stacks or piles of loose sheets of paper or the like and equally convenient withdrawal of packages of wrapped sheets or other substantially block-shaped commodities.

An additional object of the invention is to provide a novel and improved combination of bottom-, side-and end walls in a container of the above outlined character.

Still another object of the invention is to provide a novel and improved blank for rapid and predictable conversion into a container of the above outlined character.

A further object of the invention is to provide a novel and improved cover for use with the above outlined container in such a waif that it can be rapidly applied to or detached from the adjacent walls of the container.

Another object of the invention is to provide novel and improved auxiliary components for use in or with a container of the above outlined character.

An additional object of the invention is to provide a container which can be furnished in any desired practical size or shape and which occupies little room in storage or during transport to the locale of utilization for confinement of piles or stacks of paper sheets or other commodities.

Still another object of the invention is to provide novel and improved end walls for use in a container of the above outlined character.

A further object of the invention is to provide a novel and improved method of making flaps for use as constituents of the above outlined container.

Another object of the invention is to provide a container which can be readily transferred by hand between different locations irrespective of whether it is empty, partially filled or completely filled with paper sheets or other commodities.

An additional object of the invention is to provide a container which is constructed and assembled in such a way that its contents can be evacuated or expelled by automatic machinery.

SUMMARY OF THE INVENTION

The invention is embodied in a container which can be utilized for storage of one or more commodities, for example, wrapped or unwrapped stacks of paper sheets or the like. The improved container comprises a square or rectangular bottom wall having first and second sides, two first at least substantially parallel elongated marginal portions and two second at least substantially parallel elongated marginal portions. The container further comprises two sidewalls which are disposed at one side of and are inclined relative to the bottom wall. Each sidewall is integral with one of the first marginal portions of the bottom wall, and each such sidewall has a first height (as measured from the one side of the bottom wall). Still further, the container comprises at least one end wall which is inclined relative to and is disposed at the one side of the bottom wall. The at least one end wall is integral with one of the second marginal portions of the bottom wall and has a second height which is less than the (first) height of one of the sidewalls. Each sidewall further comprises a flap which overlaps with and is affixed to the at least one end wall. The flaps are spaced apart from each other.

The first marginal portions of the bottom wall are disposed at a first distance from each other, and the flaps are preferably spaced apart from each other a second distance which at most equals 50 percent of the first distance.

The at least one end wall can be provided with a handgrip portion having an opening, e.g., in the form of an elongated slot which renders it possible to insert up to four fingers of one hand.

Each flap can comprise a hollow polygonal body having a plurality of mutually inclined neighboring sections and fold lines between neighboring sections as well as between the respective sidewall and the nearest section. Each such hollow body can have a substantially square or rectangular cross-sectional outline and can comprise four sections. The sections of each such body can include a first section which is of one piece with the respective sidewall, two intermediate sections and a fourth section which is affixed to the respective sidewall.

The bottom wall can be provided with at least one window, e.g., with a substantially centrally located window.

The container can further comprise at least one partition which is removably received between and extends substantially transversely of the sidewalls. For example, a single partition can be utilized if the one side of the bottom wall is to support two neighboring stacks of paper sheets or the like; the partition is then disposed between the two stacks. The first marginal portions of the bottom wall are spaced apart from each other a predetermined distance, and the width of the properly inserted partition between the two sidewalls is preferably at least slightly less than such predetermined distance. The height of the partition (as measured from the one side of the bottom wall) can match but is preferably slightly less than the (first) height of the sidewalls.

The container can further comprise at least one withdrawable plate-like insert including a rectangular or square portion which is inwardly adjacent the flaps between the sidewalls and has a height at most matching the height of the sidewalls. Such at least one insert can further include a handgrip portion which is remote from the bottom wall when the insert is properly positioned between the sidewalls inwardly adjacent the flaps, a fold line between the two portions of the at least one insert, and an opening (e.g., in the form of an elongated slot) in the handgrip portion.

Still further, the container can comprise a removable plate-like lid which is to be placed on top of the commodity or commodities between the sidewalls. Such lid includes a square or rectangular main portion having four marginal portions, a handgrip portion which is integral with one marginal portion of the main portion and has an opening (e.g., in the form of an elongated slot), and a fold line between the main portion and the handgrip portion. The main portion of the lid is preferably dimensioned to be positionable on the one side of the bottom wall between the sidewalls and to at least substantially overlie the one side of the bottom wall when the container is empty, i.e., in the absence of one or more commodities between the sidewalls.

The sidewalls can be provided with elongated edge portions which are remote from the bottom wall, and the container can further comprise a detachable cover including a central panel which is spaced apart from and at least approximates the size of the bottom wall and overlies the edge portions of the sidewalls, and four depending lateral panels two of which are outwardly adjacent the sidewalls. The cover preferably further comprises fold lines between the central panel and the lateral panels. The lateral panels can be grouped into pairs of neighboring lateral panels and one lateral panel of each pair can be provided with a flap overlapping with and being affixed to the other lateral panel of the respective pair. The height of each lateral panel is less (and can be considerably less) than the height of a sidewall. At least one of the lateral panels can constitute a handgrip member and is then provided with an opening, e.g., in the form of an elongated slot.

The sidewalls of the improved container can be at least substantial mirror images of each other, and the marginal portions of the bottom wall can include fold lines. The container can further comprise a second end wall which is inclined relative to and is disposed at the one side of the bottom wall. The second end wall is integral with the other second marginal portion of the bottom wall and confronts the at least one end wall. The flaps are preferably mirror images of each other and the at least one end wall is preferably outwardly adjacent such flaps. The height of the second end wall can approximate the height of the at least one end wall, and each of the sidewalls can further comprise a second flap which overlaps with and is affixed to the second end wall. Each second flap can but need not be assembled and/or configurated and/or dimensioned in the same way as a flap which is affixed (preferably bonded or stapled) to the at least one end wall.

The novel features which are considered as characteristic of the invention are set forth in particular in the appended claims. The improved container itself, however, both as to its construction and the mode of assembling and using the same, together with additional features and advantages thereof, will be best understood upon perusal of the following detailed description of certain presently preferred specific embodiments with reference to the accompanying drawing.

BRIEF DESCRIPTION OF THE DRAWING

FIG. 5 is a front elevational view of a plate-like insert which is utilized in the container of FIGS. 1 and 2;

FIG. 6 is a front elevational view of a plate-like lid which is utilized in the container of FIG. 1;

FIG. 9 is an enlarged fragmentary horizontal sectional view of a modified container, the illustrated part of the modified container corresponding substantially to that within the phantom-line circle IX in FIG. 2.

DESCRIPTION OF PREFERRED EMBODIMENTS

Figure 3:
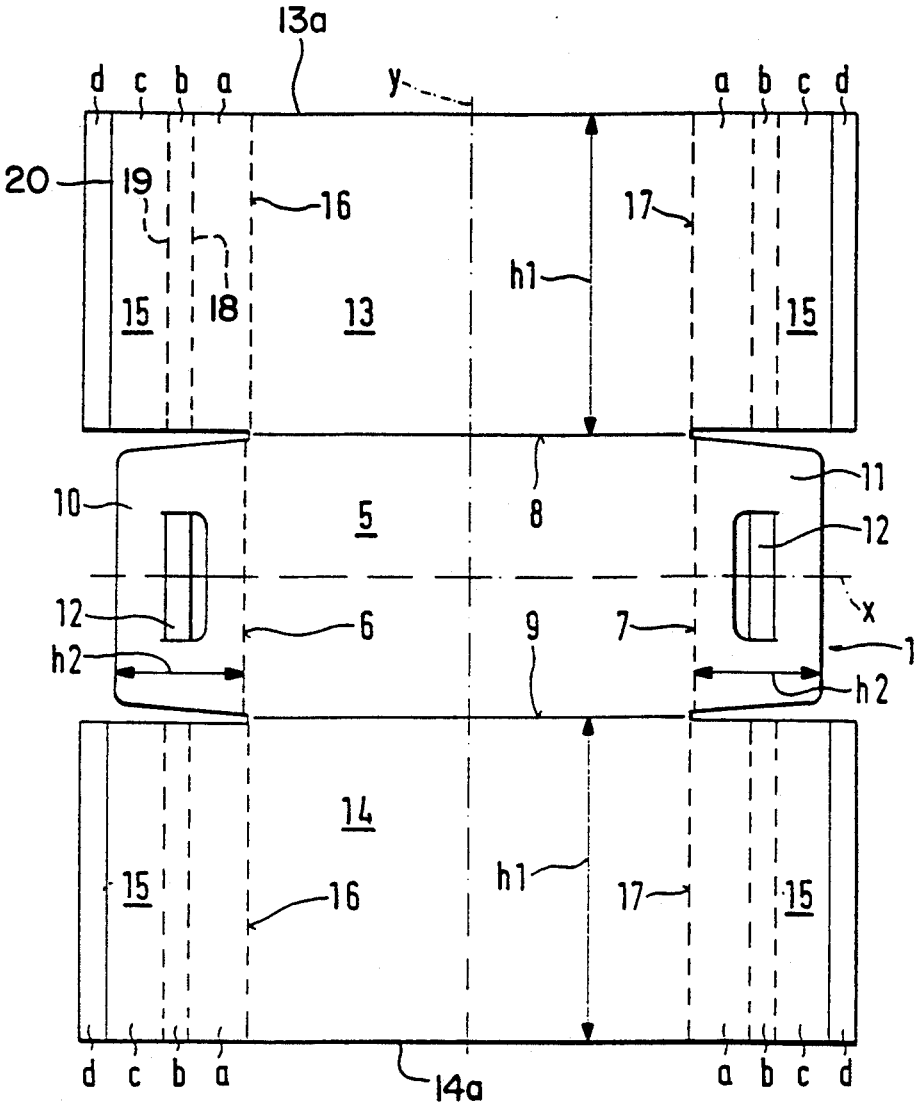
FIG. 3 is a plan view of a blank which can be converted into a container of the type shown in FIG. 2.

Referring first to FIG. 3, there is shown a blank which is made of cardboard or other suitable shape-retaining material and is designed to be converted into a container 1 of the type shown in FIGS. 1, 2, 7 and 8. The blank comprises a first panel 5 which is to constitute the bottom wall of the assembled container 1, two additional panels 13, 14 which are to constitute two spaced-apart upstanding parallel sidewalls of the container 1, and two further panels 10, 11 which are to constitute two parallel upstanding spaced-apart end walls of the container. The two longer parallel marginal portions 8, 9 of the panel 5 (hereinafter simply called bottom wall) are provided with straight fold lines and are integral (of one piece) with the respective panels 13, 14 (hereinafter called sidewalls). The two shorter parallel marginal portions 6 and 7 of the bottom wall 5 are also provided with fold lines and are integral (of one piece) with the respective panels 10, 11 (hereinafter called end walls) of the container to be made by appropriate conversion of the blank of FIG. 3. The illustrated walls 5, 10, 11, 13 and 14 have a rectangular outline; however, it is equally within the purview of the invention to select the dimensions of the walls 5, 13 and 14 so that each of these walls has a square outline or that the bottom wall 5 has a square outline whereas the sidewalls 13, 14 have rectangular outlines.

The length of the sidewalls 13, 14 equals the length of the marginal portions 8, 9 and the length of the end walls 10, 11 matches the length of the marginal portions 6, 7 of the bottom wall 5. The height $h_1$ of the sidewalls 13, 14 (as measured from the upper (inner) side of the bottom wall 5) exceeds the height $h_2$ of the end walls 10 and 11. For example, the height $h_2$ can equal or approximate $\frac{1}{2}h_1$. Furthermore, the height of the end wall 10 need not match the height of the end wall 11; it is presently preferred to select each of these heights to be less than $h_1$.

Those parts of the end walls 10, 11 which are remotest from the respective marginal portions 6, 7 of the bottom wall 5 are preferably designed to constitute simple handgrip portions which are provided with openings in the form of elongated slots 12 extending in parallelism with the respective marginal portions 6 and 7. This simplifies manipulation of the assembled container 1, e.g., its transfer between different locations, in that the person in charge uses several fingers of each of her or his hands to grasp the handgrip portions of the end walls 10 and 11.

Each of the two sidewalls 13 and 14 further comprises two rectangular extensions which can be converted into flaps 15. Such extensions are separated from the central or main portions of the sidewalls 13, 14 by fold lines 16 (which are aligned with the marginal portion 6) and 17 (which are aligned with the marginal portion 7) along which the respective extensions can be folded to positions substantially or exactly at angles of 90° relative to the main portions of the corresponding sidewalls. Additional fold lines 18, 19, 20 divide each extension into four parallel sections a, b, c and d of different widths and enable the person in charge or an automatic machine to convert each extension into an elongated hollow tubular body or flap 15 (see FIGS. 1, 2, and 8). The flaps 15 at the end wall 10, as well as the flaps 15 at the end wall 11, confront each other between the sidewalls 13, 14 and are separated from one another a distance which at most equals but can be and preferably is less than half the distance of the marginal portions 8 and 9 from one another. This exposes the contents (e.g., a pile of overlapping paper sheets, foils or the like) of the assembled and at least partially filled container 1 and affords convenient access to such contents, at least in the regions above the end walls 10 and 11. The end wall 10 overlies the outer sides of the adjacent pair of spaced-apart flaps 15, and the end wall 11 overlies the outer sides of the other two flaps 15 in a fully assembled container 1. The end walls 10, 11 are affixed (e.g., adhesively secured, to the respective pairs of flaps 15.

The section a of each flap 15 is of one piece with main fold lines (at 16 or 17) and after folding on the main fold line is disposed at right angles to the respective sidewall 13 or 14, the section b is of one piece with and is disposed at right angles to the adjacent section a, the section c is of one piece with and is disposed at right angles to the adjacent section b, and the section d is of one piece with and is disposed at an angle of 90° to the adjacent section c. The section d of each flap 15 is affixed (e.g., adhesively secured and/or stapled) to the inner side of the respective sidewall 13 or 14. Each of the illustrated flaps 15 has an elongated rectangular cross-sectional outline; however, it is equally possible to design and employ flaps which have a substantially square cross-sectional outline. Furthermore, all dimensions of one flap 15 of each pair of neighboring flaps preferably do but need not always match the dimensions of the other of these flaps.

Since the end walls 10, 11 are disposed at the outer sides of the respective neighboring pairs of flaps 15, their openings 12 are spaced apart from the contents of the container 1 which renders it more convenient for insertion of fingers from the outside, e.g., for the purpose of transferring a filled or partially filled or empty container 1 to a different location.

FIG. 3 further shows that the sidewalls 13, 14 are mirror images of each other with reference to a plane extending at right angles to the plane of FIG. 3 and including the abscissa X of a simple coordinate system. Analogously, the end walls 10 and 11 are mirror images of each other with reference to a plane which is normal to the plane of FIG. 3 and includes the ordinate Y of the coordinate system.

The flaps 15 cooperate with the respective end walls 10, 11 to maintain the sidewalls 13, 14 in planes at right angles to the plane of the bottom wall 5. Furthermore, the flaps 15 at each end of the container 1 establish a clearance or $ga_D$ above the respective end wall 10 or 11 to expose and to afford access to the contents of the container. Still further, the flaps 15 reinforce the upright corner portions of the assembled container 1. In addition, the hollow polygonal flaps 15 facilitate insertion of fingers through the openings 12 of the end walls 10, 11 because each of these end walls preferably overlies and is affixed to the outer sides of the respective pair of flaps 15. This ensures that the openings 12 are spaced apart from the adjacent side of the stack of paper sheets or other commodities in the container 1. As already mentioned above, it is presently preferred to select the dimensions of the flaps 15 in such a way that the width of the clearance or gap between two confronting flaps at the respective end of the container 1 does not exceed and can be less than one-half the distance between the sidewalls 13 and 14.

Figure 1:
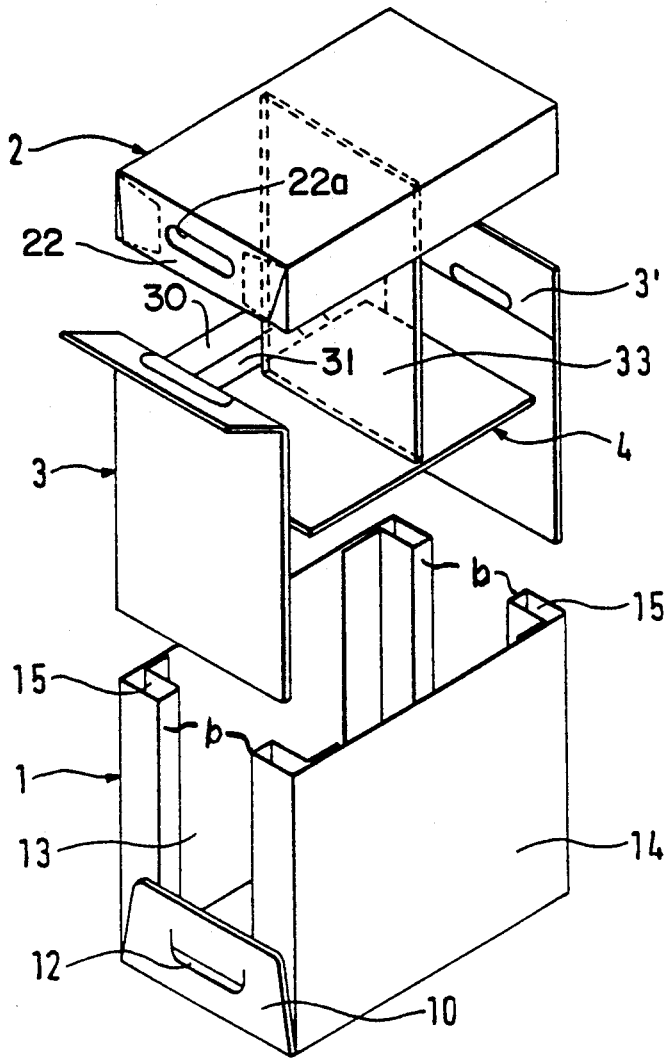
FIG. 1 is a schematic exploded perspective view of a container which embodies one form of the invention.
Figure 2:
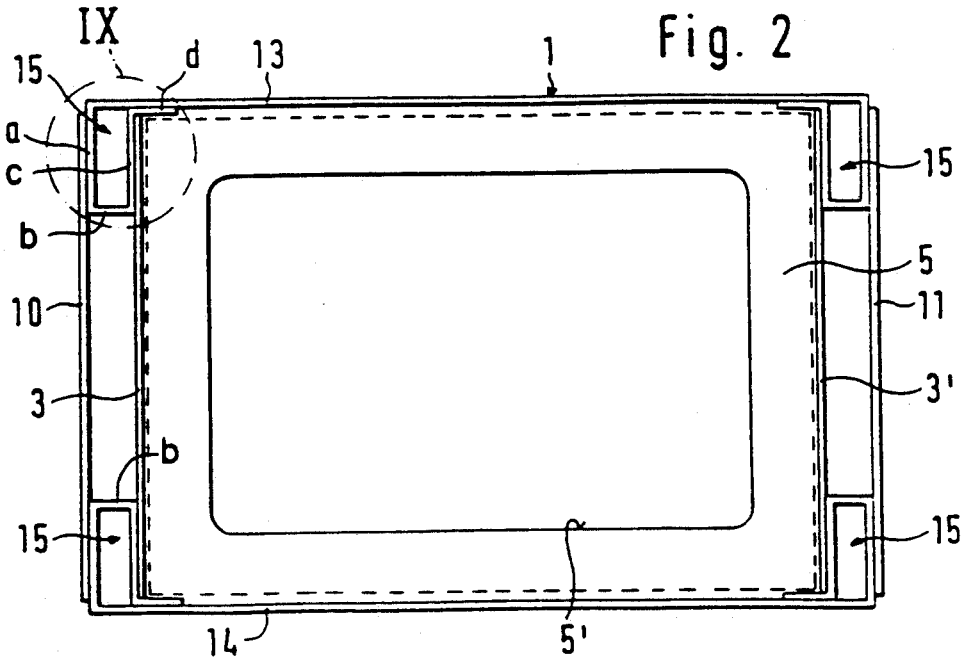
FIG. 2 is an enlarged plan view of the assembled container, with the cover removed.

In assembling the container 1, one can proceed as follows: The flaps 15 are formed in a first step and the sidewalls 13, 14 are thereupon pivoted relative to the bottom wall 5 along the respective fold lines 8 and 9 which are suitably formed to ensure adequate weakening of the junctions between the bottom wall and the sidewalls. The next step involves pivoting of the end walls 10, 11 along the fold lines 6, 7 and bonding, stapling and/or otherwise affixing of the end walls to the adjoining pairs of flaps 15. The container 1 is then ready to receive commodities, e.g., a single stack of paper sheets or the like. Such sheets are centered by the sections c of the four flaps 15 whose sections d are bonded, stapled and/or otherwise affixed to the inner sides of the respective sidewalls 13, 14. The exposed sides of the sections d of all four flaps 15 can also contribute to centering of sheets in the container 1. Introduction and/or removal of sheets is facilitated due to the fact that the end walls 10, 11 do not extend all the way to the upper edge portions 13*a*, 14*a* of the sidewalls 13 and 14. As can be seen in FIG. 1, the height $h_2$ of each of the end walls 10, 11 can be a relatively small fraction of the height $h_1$ of the sidewall 13 or 14.

The container 1 can be provided with only one of the end walls 10, 11. However, the provision of two end walls is preferred in many instances, especially since this facilitates manual transportation of the container between different locations since each of the two end walls can include a handgrip portion with an opening 12.

Figure 4:
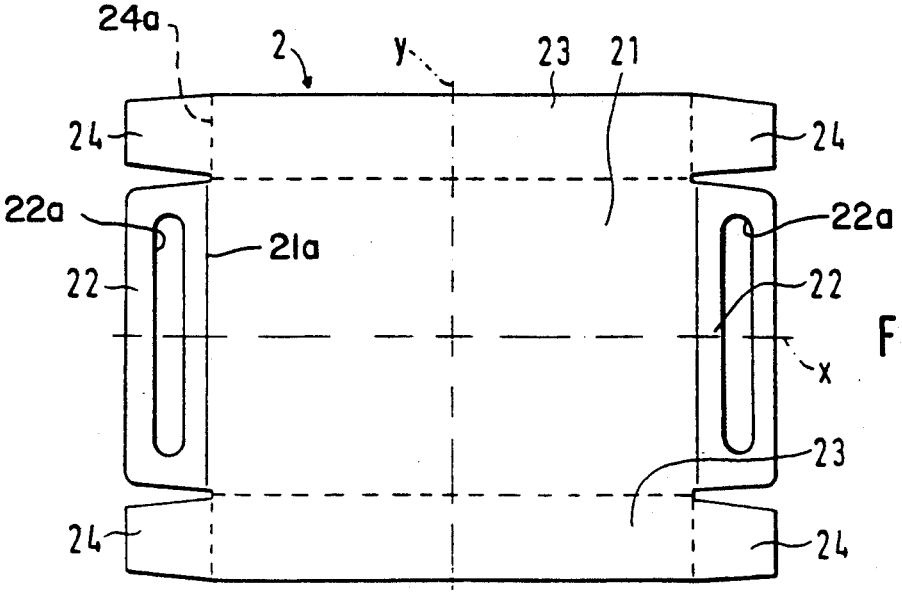
FIG. 4 is a plan view of a blank which can be converted into a cover of the type shown in the uppermost portion of FIG. 1.

FIG. 4 shows a second blank which can be converted into a cover 2 of the type shown in the uppermost portion of FIG. 1. This blank includes a central panel 21 which constitutes the top wall of the finished cover 2, and two pairs of elongated portions 22 and 23 which constitute the depending lateral panels of the finished cover. The central panel 21 is integrally connected with the panels 22, 23 along straight fold lines 21*a* which facilitate conversion of the blank of FIG. 4 into a cover 2. Each portion or panel 23 has two end flaps 24 (with a fold line 24*a* between them) which can be bent to positions at right angles to the positions of FIG. 4 and adhesively secured and/or otherwise affixed to the adjacent ends of the respective portions or panels 22. It is clear that the flaps 24 (or some of these flaps) can be provided on the panels 22 without departing from the spirit of the invention, as long as one of each pair of neighboring panels 22, 23 is provided with a flap 24 which can be used to affix the panels of such pair to each other in positions at right angles to the plane of the central panel 21. When the fully assembled cover 2 is telescoped onto the fully assembled main part of the container 1, the longer lateral panels 23 overlie the adjacent portions of the external surfaces of the sidewalls 13, 14, the shorter lateral panels 22 are spaced apart from the respective end walls 10, 11 .and the underside of the central panel 21 rests on or is close to the elongated edge portions 13*a*, 14*a* of the sidewalls 13 and 14.

When the cover 2 is properly applied to the main part of the container 1, it can be reliably held in such position by one or more cords, ropes, wires, straps, adhesive tape or the like, and an operator can transfer the assembly of container 1, cover 2 and the contents of the container by engaging the handgrip portions at the upper ends of the end walls 10, 11 or by engaging the depending lateral panels 22 of the cover 2. With reference to FIG. 1, the panels 22 can be engaged in the clearances or gaps between the sections b of the adjacent flaps 15.

At least the panels 22 of the cover 2 can constitute handgrip portions and are then provided with openings 22*a* (one shown in FIG. 1).

The improved container can further comprise several optional additional parts. Such parts include two removable plate-like inserts 3 and 3' which can be slipped into the container 1 adjacent the inner sides of the flaps 15 contacting the end wall 10 and adjacent the inner sides of flaps 15 which contact the end wall 11. The insert 3' may be identical with the insert 3, one presently preferred form of which is shown in FIG. 5. The illustrated insert 3 comprises a rectangular or square main portion 28 and a handgrip portion 25 which is integral with the portion 28 along a straight fold line 25*a*. The portion 25 is provided with an opening 26 in the form of an elongated slot which facilitates manual introduction of the insert 3 into or its extraction from the assembled container 1. Such introduction can take place prior to, during or upon completion of filling of the container 1 with commodities, e.g., packages containing wrapped reams of copy paper or the like. When the insert 3 is properly introduced into a container 1, it bridges the clearance or gap between the adjoining flaps 15 to conceal the contents of the container. The handgrip portion 25 can be folded along the line 25*a* to overlie the uppermost sheet of a stack of sheets or the uppermost package of a stack of packages in the container 1. This provides room for proper positioning of the cover 2 so that the underside of the central panel 21 of the cover can come to rest on the adjacent edge portions 13*a*, 14*a* of the respective sidewalls 13 and 14.

The inserts 3, 3' can be used during prolonged storage of a container 1 and its contents. They prevent penetration of dust, moisture and/or other foreign matter through the clearances or gaps between the pairs of confronting flaps 15 above the handgrip portions of the respective end walls 10 and 11. The width of each insert can be at least slightly less than the distance of the sidewalls 13, 14 from each other but preferably at least slightly exceeds the distance of two neighboring flaps 15 from one another. The height of each insert can equal or approximate the height $h_1$ of the sidewall 13 or 14. Each of the inserts 3 and 3' can be readily extracted from the container 1 as soon as the cover 2 is lifted off the upper portions of the sidewalls 13 and 14. The provision of handgrip portions 25 facilitates insertion as well as extraction of the respective inserts. It is not even necessary to extract the insert 3 with the insert 3' or vice versa, i.e., one of these inserts can remain in the container 1 because extraction of the other insert suffices to afford convenient access to the contents of the container. The extracted insert 3 or 3' can be reinserted as soon as the evacuation of the contents of the container 1 is interrupted. The handgrip portions 25 of properly introduced inserts 3, 3' are folded inwardly, . i.e., over the adjacent portions of confined sheets or other commodities, so that they do not interfere with the application or reapplication of the cover 2.

An additional optional but desirable and advantageous constituent of the improved container 1 is a plate-like lid 4 (FIGS. 1 and 6) which can be placed on top of the commodity or commodities in the container 1 prior to application of the cover 2 or while the cover 2 is detached from the upper portions of the sidewalls 13 and 14. The lid 4 includes a square or rectangular main portion 29 whose size can match or approximate the size of the bottom wall 5, and an elongated handgrip portion 30 which is integrally connected to the adjacent marginal portion of the main portion 29 by a fold line 30*a*. The handgrip portion 30 has an opening 31 in the form of an elongated slot which facilitates manual lifting, shifting or deposition of the lid 4. The dimensions of the main portion 29 are or can be selected in such a way that it at least substantially or at least nearly fully overlaps the upper side of the bottom wall 5 between the sidewalls 13, 14 and end walls 10, 11 when the container 1 is empty.

The lid 4 is preferably dimensioned to fit between the sections c of the four flaps 15 so that it can be placed on top of one or more stacks of sheets or the like in the container 1 regardless of whether the container is filled to capacity or in part. Once the lid 4 is or has been moved to a selected position, e.g., to a selected level between the sections c of the four flaps 15, the handgrip portion 30 is preferably folded along the line 30*a* to overlie the upper side of the main portion 29.

The container 1 can be furnished with one or more square or rectangular partitions 33 (one shown in FIG. 1) which are dimensioned to be readily insertable between the sidewalls 13, 14 at a selected distance from the end walls 10 and 11. For example, the container 1 will be used with a single partition 33 if the upper side of the bottom wall 5 supports two neighboring stacks of overlapping paper sheets or the like and the two neighboring stacks should be separated from each other.

Figure 7:
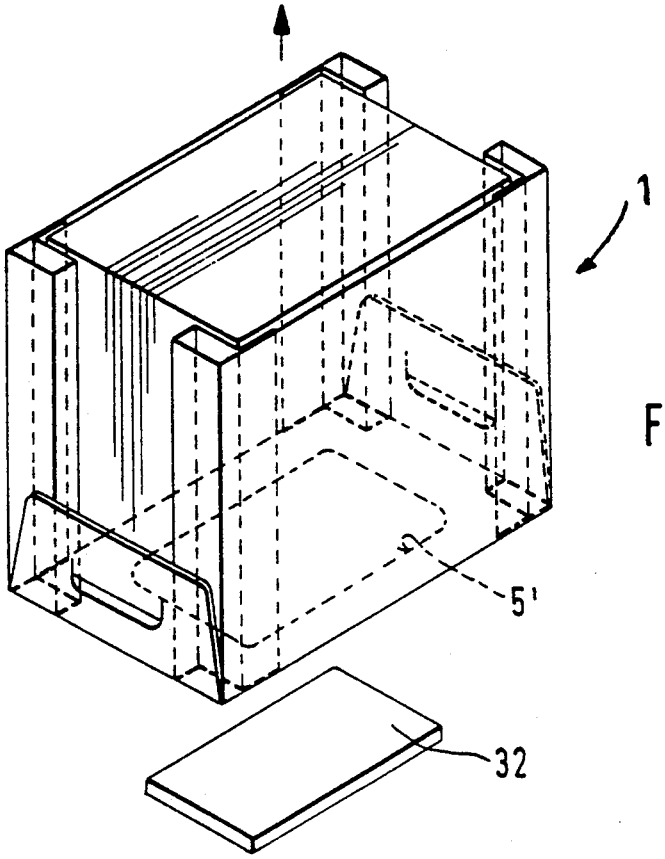
FIG. 7 is a perspective view of a filled container with the cover removed, and further showing a movable member of a machine for automatic expulsion or evacuation of the contents of the container.
Figure 8:
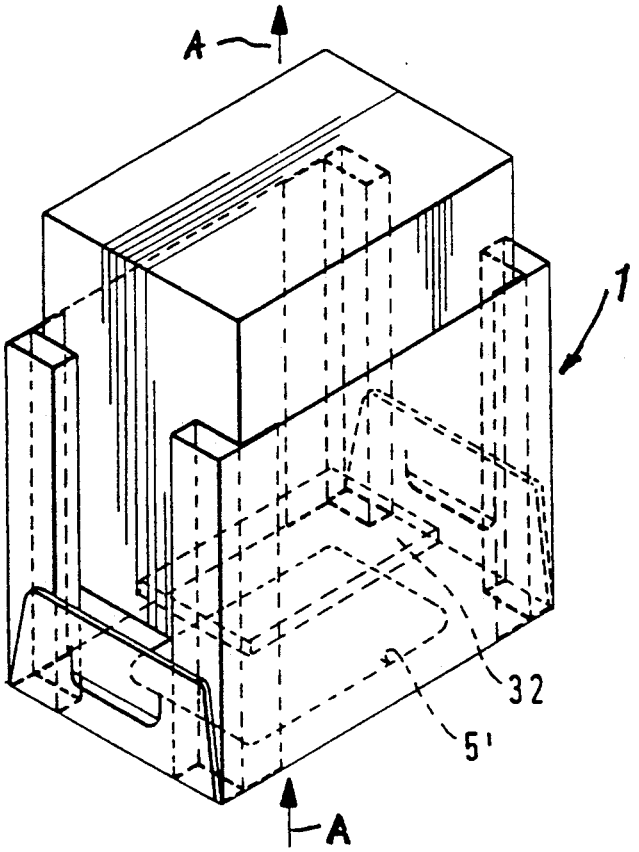
FIG. 8 is a similar perspective view but with the movable member of the evacuating machine in the process of expelling the contents through the open top of the container.

FIGS. 2, 7, 8 and 9 show that the bottom wall 5 can be provided with a preferably centrally located opening 5' (hereinafter called window) which renders it possible to automatically expel or evacuate the contents of the container 1 through the open top between the upper edge portions 13*a*, 14*a* of the sidewalls 13, 14 upon lifting of the cover 2. FIGS. 7 and 8 show a plate-like plunger 32 of an automaton (the exact design of such automaton forms no part of the present invention). The plunger 32 can be lifted in the direction of arrow A from the position of FIG. 7 to and upwardly beyond the position of FIG. 8 to thereby lift the contents of the container 1 above and away from the upper side of the bottom wall 5. If the container 1 was filled with a single pile or stack of sheets, a singularizing device (not shown) above the container of FIGS. 7 and 8 can be set in operation to advance successive uppermost sheets of the diminishing stack in the desired direction or directions. The plunger 32 is dimensioned to ensure that it can pass through the window 5' of the bottom wall 5.

The window 5' can be formed subsequent to filling of the container 1 with one or more stacks or packages of sheets and/or other commodities. For example, the bottom wall 5 can be provided with perforations or is otherwise weakened to permit rapid and convenient detachment of its central portion and to thus form the window 5'.

The automatic evacuating or ejecting machine which includes the plunger 32 of FIGS. 7 and 8 can comprise a rectangular or square frame which supports the bottom wall 5 in a preferably horizontal plane and such a way that the window 5' is accessible to the plunger from below. The plunger 32 can be lifted, at a selected speed, continuously or stepwise, in order to expose the upper portion(s) of the stack(s) of sheets in the container 1 at a desired rate for manual or mechanical removal of individual uppermost sheets or groups of two or more topmost sheets.

The partition 33 will be put to use if the container 1 is used for simultaneous storage of several neighboring piles of sheets or the like. For example, the partition 33 will be inserted if the freshly evacuated container 1 (which was previously filled with relatively large sheets so that a single stack sufficed to fill the container) is to be filled with smaller sheets to form two neighboring stacks with the partition 33 between such stacks. This partition can be provided with a handgrip portion (e.g., corresponding to the handgrip portion 25 of FIG. 5 or to the handgrip portion 30 of FIG, 6) in order to facilitate insertion as well as extraction of such partition.

FIG. 9 illustrates a portion of a modified container. The flaps 15 of this container are genuine flaps, i.e., each such flap can merely constitute the section a of a flap of the type shown in FIGS. 1, 2, 7 and 8. This simplifies the making of the blank for the modified container and the assembly of the container (because the simple flap 15 must be bonded at a single point, namely to the adjacent end wall 10 or 11). However, this also reduces the width of the space between the outer side of the flap 15 of FIG. 9 and the adjacent side of a pile of sheets or the like in the modified container. Nevertheless, and if the material of the flap 15 of FIG. 9 is not very thin, this suffices to facilitate insertion of fingers into the opening 12 (not shown in FIG. 9) of the adjacent end wall 10 or 11.

A further advantage of a blank which can be converted into the container of FIG. 9 is that the extensions of the sidewalls are much shorter than those shown in FIG. 1. Thus, each extension is constituted by a single section corresponding to one of the sections a shown in FIGS. 2 and 3.

FIG. 9 further shows that at least one of the inserts (this Figure shows the insert 3) can be made of several layers of relatively stiff material to even more reliably shield the confined material in the gap between the adjacent flaps 15. The insert 3 of FIG. 9 comprises several layers of corrugated cardboard having different thicknesses. Such relatively thick insert 3 can be provided with a recess or with a cutout in line with the opening 12 (not shown in FIG. 9) of the adjacent end wall 10 or 11 to permit more convenient introduction of fingers when the upper part of the end wall 10 or 11 is used as a handgrip portion to facilitate transfer of the container to a different location. This also renders it possible to dispense with the opening 26 and handgrip portion 25 because one or more recesses or cutouts in the lower portion of the relatively thick insert 3 of FIG. 9 facilitate manipulation of such insert, particularly its extraction from the container 1.

Apparatus for manipulation of stacks of paper sheets or the like capable of being confined in containers of the present invention are disclosed, for example, in commonly owned U.S. Pats. Nos. 4,842,572 granted Jan. 27, 1989 for "Apparatus for subdividing a running web of panels in zig-zag formation into stacks"), 4,955,854 (granted Sep. 11, 1990 for "Apparatus for subdividing stacks of sheets of paper and the like ") and 5,051,058 (granted Sep. 24, 1991 for "Apparatus for palletizing stacks of paper sheets and the like").

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A container comprising:

a square or rectangular bottom wall having first and second side edges and first and second end edges;

a pair of sidewalls, each of said sidewalls being attached to and upwardly extending from one of said side edges of said bottom wall, each of said sidewalls having a first height as measured from said bottom wall; and at least one end wall attached to and extending upwardly from one of said end edges of said bottom wall, said at least one wall having a second height less than said first height, each of said sidewalls further having a flap overlapping with and affixed to said at least one end wall, said flaps being spaced apart from each other, and said at least one end wall having an opening forming a handgrip portion.

2. The container of claim 1, wherein said flaps are spaced apart from each other by a distance not greater than one-half of the distance between the bottom wall side edges.

3. The container of claim 1, wherein each of said flaps comprises a hollow polygonal body having a plurality of mutually inclined neighboring sections and fold lines being disposed between said neighboring sections.

4. The container of claim 3, wherein each of said bodies has a substantially square or rectangular cross-sectional outline and comprises four sections.

5. The container of claim 4, wherein said sections of each of said bodies include a first section which is of one piece with the respective sidewall, two intermediate sections and a fourth section affixed to the respective sidewall.

6. The container of claim 1, wherein said bottom wall has a substantially centrally located window.

7. The container of claim 1, further comprising at least one partition removable received between and extending substantially transversely of said sidewalls.

8. The container of claim 7, wherein said bottom wall side edges are spaced apart from each other by a predetermined distance and said at least one partition has between said sidewalls a width at least slightly less than said predetermined distance, said at least one partition having a third height equal to or less than said first height.

9. The container of claim 1, further comprising at least one widthdrawable insert including a rectangular or square portion inwardly adjacent said flaps between said sidewalls and having a third height which is not greater than said first height.

10. A container comprising:

a square or rectangular bottom wall having first and second side edges and first and second end edges;

a pair of sidewalls, each of said sidewalls being attached to and upwardly extending from one of said side edges of said bottom wall, each of said sidewalls having a first height as measured from said bottom wall; and at least one end wall attached to and extending upwardly from one of said end edges of said bottom wall, said at least one wall having a second height less than said first height, each of said sidewalls further having a flap overlapping with and affixed to said at least one end wall, said flaps being spaced apart from each other; and at least one withdrawable insert including a rectangular or square main portion inwardly adjacent said flaps between said sidewalls and having a third height which is less than or equal to said first height, said at least one insert having a handgrip portion remote from said bottom wall, a fold line between said main and said handgrip portions, and an opening in said handgrip portion.

11. A container comprising:

a square or rectangular bottom wall having first and second side edges and first and second end edges;

a pair of sidewalls, each of said sidewalls being attached to and upwardly extending from one of said side edges of said bottom wall, each of said sidewalls having a first height as measured from said bottom wall; and at least one end wall attached to and extending upwardly from one of said end edges of said bottom wall, said at least one wall having a second height less than said first height, each of said sidewalls further having a flap overlapping with and affixed to said at least one end wall, said flaps being spaced apart from each other, a removable lid arranged to be placed on top of contents in the container between said sidewalls and including a main portion having marginal portions, a handgrip portion integral with one of said marginal portions of said lid main portion and said handgrip portion having an opening, and a fold line between said lid main portion and said handgrip portion.

12. The container of claim 11, wherein said lid main portion is dimensioned to be positionable on a top surface of said bottom wall between said sidewalls and to at least substantially overlie said top surface in the absence of contents in the container between said sidewalls.

13. A container comprising a sheet of material having:

a square or rectangular bottom wall having first and second side edges and first and second end edges;

a pair of sidewalls, having a predetermined height, each of said sidewalls being attached to and folded upwardly from one of said side edges, an end wall attached to and folded upwardly from one of the end edges of said bottom wall, said end wall having a height less than that of each of said side walls, each of said side walls being adjacent to said at least one end wall and having a plurality of sections, said plurality of sections are folded to form a rectangular support column extending along the height of the respective sidewall, the columns of said respective sidewall being spaced from one another, said end wall being attached to said columns leaving a space between the columns above a top of said end wall to a top of the pair of sidewalls, and a headwall disposed between said sidewalls at one end of said sidewalls and engaging a flat portion of each of said columns, said headwall having a height that is approximately equal to a height of said sidewalls.

14. A container as in claim 13 further including a second headwall at the other end of said sidewalls.

15. A container as in claim 14 further comprising:

a cover having a shape corresponding to the container sidewalls with a downwardly extending rim overlying the top of said sidewalls and a top of each of said headwalls.

16. A container as in claim 14 wherein said end wall has a cutout.

17. A container as in claim 15 wherein said cover has a cutout in each part of said downwardly extending rim overlying said headwall.

18. A container as in claim 13 wherein said bottom wall has a cutout portion.

19. A container as in claim 14 wherein each of said headwalls has a cutout portion adjacent to a top of said headwall.

20. A container as in claim 19 wherein said headwall cutout portion is in a foldable flap portion of said headwall.

21. A container as in claim 15 further comprising a lid which fits under said cover, said lid having a flap portion with a cutout portion, the lid flap portion being foldable over toward the bottom wall.

22. A container as in claim 13 further comprising a separate vertical partition having a height less than said sidewalls extending between said sidewalls.

* * * * *